US007421816B2

(12) United States Patent
Conescu

(10) Patent No.: US 7,421,816 B2
(45) Date of Patent: Sep. 9, 2008

(54) WEAPON SIGHT

(76) Inventor: Paul Conescu, 3118 8th St., Las Vegas, NM (US) 87701

( * ) Notice: Subject to any disclaimer, the term of this patent is extended or adjusted under 35 U.S.C. 154(b) by 241 days.

(21) Appl. No.: 11/311,011

(22) Filed: Dec. 19, 2005

(65) Prior Publication Data

US 2007/0137090 A1 Jun. 21, 2007

(51) Int. Cl.
*F41G 1/473* (2006.01)
*F41G 1/387* (2006.01)
*F41G 3/06* (2006.01)
*F41G 3/08* (2006.01)

(52) U.S. Cl. ..... 42/122; 42/114; 42/117; 42/142

(58) Field of Classification Search ..... 42/117, 42/122, 114, 142; 89/37.18, 37.19, 37.21, 89/37.22

See application file for complete search history.

(56) References Cited

U.S. PATENT DOCUMENTS 1,434,367 A * 11/1922 Cato ..... 89/37.18
2,291,867 A * 8/1942 Birkigt ..... 89/37.18
3,694,095 A * 9/1972 Louthan ..... 356/255
3,751,166 A * 8/1973 Starkey et al. ..... 356/5.04
4,020,324 A * 4/1977 Buscher et al. ..... 235/400
4,084,480 A 4/1978 Moscrip
4,244,272 A 1/1981 Terry et al.
4,263,719 A 4/1981 Murdoch
4,309,095 A 1/1982 Buckley
4,561,204 A * 12/1985 Binion ..... 42/122
4,606,256 A 8/1986 De'Ath
4,777,352 A 10/1988 Moore
4,965,439 A 10/1990 Moore
5,026,158 A 6/1991 Golubic
5,375,072 A 12/1994 Cohen
5,378,155 A * 1/1995 Eldridge ..... 434/11
5,497,704 A 3/1996 Kurschner et al.
5,686,690 A * 11/1997 Lougheed et al. ..... 89/41.17
5,822,713 A 10/1998 Profeta
6,226,880 B1 5/2001 Pitre
6,269,581 B1 * 8/2001 Groh ..... 42/122
6,516,699 B2 2/2003 Sammut et al.
6,813,025 B2 11/2004 Edwards
2004/0020099 A1 2/2004 Osborn, II
2004/0088898 A1 5/2004 Barrett

OTHER PUBLICATIONS

Unknown, "M1A1 Abrams Tank," http://www.tankopoly.com/M1A1_Abrams_Tank.htm, Jun. 8, 2008, pp. 1-6.

* cited by examiner

*Primary Examiner*—Stephen M Johnson
(74) *Attorney, Agent, or Firm*—Hoffman Warnick LLC

(57) ABSTRACT

The invention includes a sighting system for use with a firearm that has a telescopic sight, a laser rangefinder for providing the distance to the target, device(s) for receiving various inputs, a computing system that calculates the point of aim of the firearm's projectile based upon the input(s) and the calculated distance to the target, and a display means that provides an image of the computed point of aim within the telescopic sight's field of view. A method and weapon that employs the sighting system is disclosed.

17 Claims, 6 Drawing Sheets

WEAPON SIGHT

BACKGROUND OF THE INVENTION

1. Technical Field

The invention relates generally to a weapon sighting device to be attached to or integrated with a rifle or handgun, and more specifically, to a weapon sight and sighting system that improves the accuracy of the firing of a rifle or handgun by providing an improved anticipated point of impact of the projectile.

2. Background Art

In the art of firearm sights and sighting systems there are various products available that aid the shooter with viewing an intended target and informing the shooter as to the anticipated point of impact on the target of the projectile, or round. Several parameters influence the trajectory of the projectile, ultimately altering the trajectory of the round so that the actual point of impact differs from the anticipated point of impact. As these sights and sighting systems improve in their incorporation and compensation for these numerous parameters, the difference between the anticipated point of impact and the actual point of impact will be reduced. This will improve the accuracy of the weapon on actual shots made and also will aid the shooter in his decision as to whether or not to pull the trigger.

Currently, for example, there are trajectory scopes that automatically compensate for the projectile drop, due to gravity, over a range of distances to the target.

LEATHERWOOD™ is one such product on the market that compensates for bullet drop from 200 to 600 yards. This type of system requires the shooter to obtain the actual distance to the target by other means and will not allow for ongoing, interactive adjustments of the sight or weapon.

Currently available are various holographic sight systems that project a holographic image onto the sighting plane, for example, 50 yards beyond the muzzle. One such system is HOLOsight Gen III made by Bushnell®.

Another sighting system is termed red-dot sight which projects a red dot within the field of view of the telescopic sight thereby providing the shooter a fast target acquisition. One such system is made by Aimpoint®.

There are available handheld range finding systems that project a laser onto a target and obtains a distance-to-target. One system by Leica® continuously corrects the distance-to-target on a slow-moving target.

Further, various data are available in the field of ballistics such as ballistic tables that include data such as ballistic coefficient, muzzle velocity and bullet drop for various cartridge and firearm combinations. These data aid further in predicting the actual trajectory of a particular round.

While all these devices and systems aid in reducing the difference between the anticipated point of impact and the actual point of impact, all the devices and systems have limitations.

As a result, a need exists for an improved firearm sighting system that, within a single device or system, addresses one or more of these limitations and/or other limitation(s) not expressly discussed herein, thereby providing an improved anticipated point of impact of the projectile.

SUMMARY OF THE INVENTION

The invention provides an improved weapon sight that may be either integrated into a firearm or removably attached thereto. The weapon sight incorporates several elements so as to ultimately provide a more accurate shooting experience.

A first aspect of the invention provides a sighting system for use with a firearm comprising: a telescopic sight, that provides a field of view of a desired target; a laser rangefinder, adapted to obtain a distance to the desired target; a device for receiving an input; a computing system, for calculating point of aim of a projectile based upon the input and the distance to the desired target; and a display means configured to provide an image of the computed point of aim within the field of view.

A second aspect of the invention provides a method for sighting a weapon comprising: providing a telescopic sight, that provides a field of view of a desired target; providing a laser rangefinder, adapted to obtain a distance to the desired target; providing a device for receiving an input; providing a computing system, for calculating a point of aim of a projectile based upon the input and the distance to the desired target; and displaying an image of the computed point of aim within the field of view.

A third aspect of the invention provides a firearm comprising: a system including a telescopic sight, that provides a field of view of a desired target; a laser rangefinder, adapted to obtain a distance to the desired target; a device for receiving an input; a computing system, for calculating a point of aim of a projectile based upon the input and the distance to the desired target; and a display means configured to provide an image of the computed point of aim within the field of view; a trigger; a barrel; and a projectile loading area.

The illustrative aspects of the present invention are designed to solve the problems herein described and other problems not discussed, which are discoverable by a skilled artisan.

BRIEF DESCRIPTION OF THE DRAWINGS

These and other features of this invention will be more readily understood from the following detailed description of the various aspects of the invention taken in conjunction with the accompanying drawings in which.

It is noted that the drawings of the invention are not to scale. The drawings are intended to depict only typical aspects of the invention, and therefore should not be considered as limiting the scope of the invention. In the drawings, like numbering represents like elements between the drawings.

DETAILED DESCRIPTION OF THE INVENTION

Figure 1:
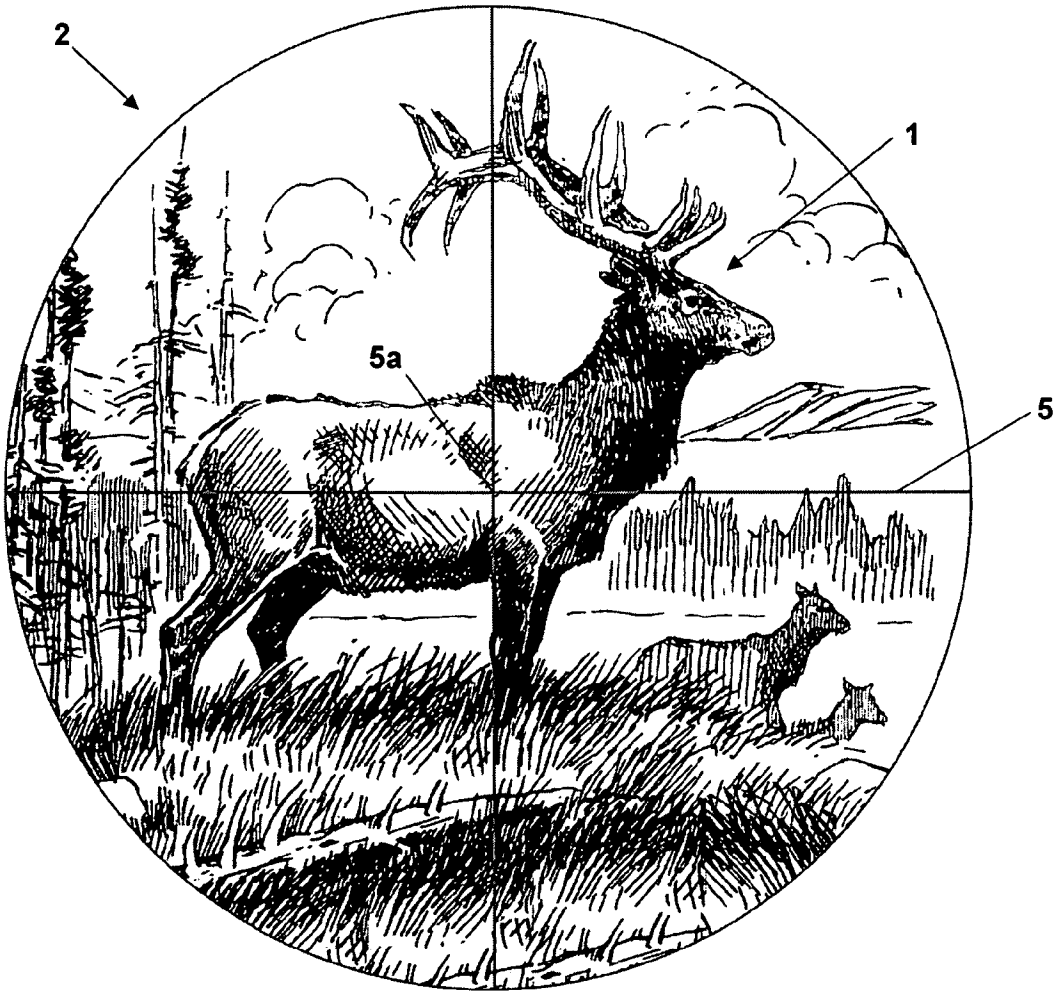
FIG. 1 shows an unimproved field of view of an intended target through a telescopic sight.

A typical, or unimproved, field of view 2 that is available in a standard telescope sight is shown in FIG. 1, wherein an intended target 1 (e.g., animal, human, fixed target, etc.) is visible, and often magnified. Typically a reticle 5 is also within the field of view 2 as an aiding instrument to the shooter. The reticle 5 aids the shooter in firing towards the intended target 1 by showing where the point of aim of the weapon 90 will be. In FIG. 1 a standard cross-hair type reticle 5 is employed wherein the point of aim is shown at point 5*a* (i.e., where the cross-hairs intersect) for a predetermined distance to the target (e.g., 200 feet to intended target). If a distance computing laser is additionally used on the weapon, the reticle 5 additionally may show the focal point of the distance computing laser 5*a*. With the field of view 2 with the standard telescopic sight, the shooter cannot accurately discern how far to move the intersection of the crosshairs 5*a* (via moving the weapon), in order to properly compensate for various vertical and/or horizontal effects (e.g., movement of target 1, cross-wind, bullet drop, temperature, altitude, elevation/declination, etc.) on the bullet's trajectory to intended point of impact. For example, the various effects make it difficult to accurately have the bullet hit the elk a vital area.

The present invention includes a weapon sight that employs a system that ultimately improves the firing accuracy of the firearm. The weapon sight system may be either integrated into a firearm, during manufacturing, or fixed or removably attached to a pre-existing firearm.

Figure 2A:
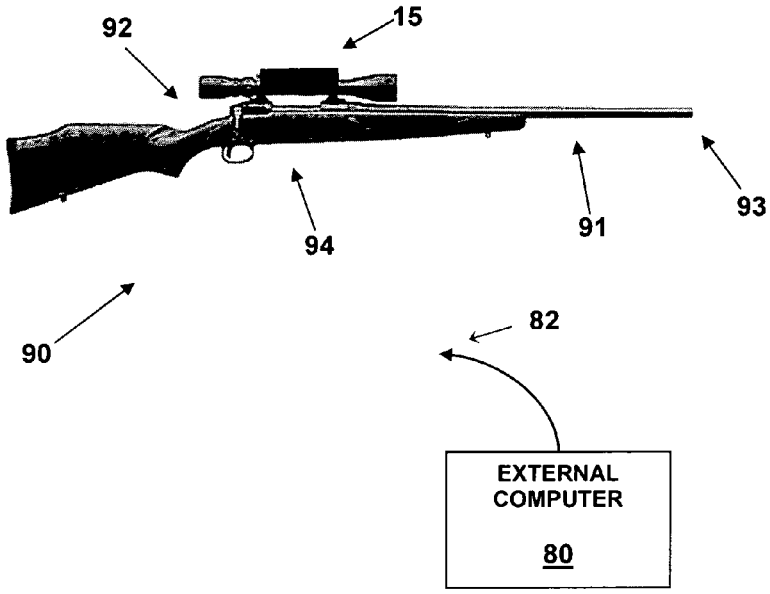
FIG. 2A shows a side view of a weapon sight system employed with a rifle, according to an embodiment of the present invention.
Figure 2B:
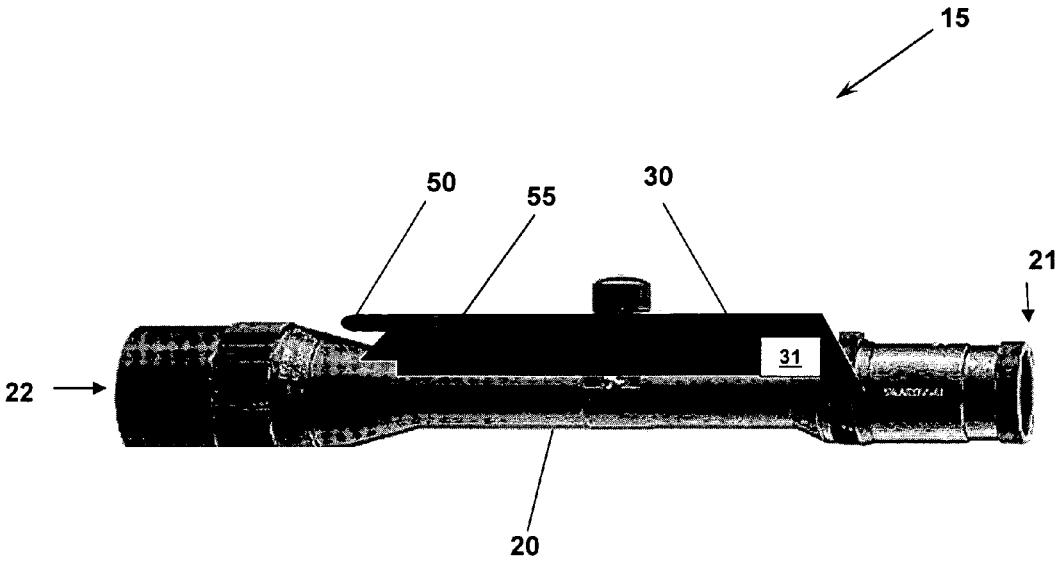
FIG. 2B shows a close-up view of a weapon sight, according to an embodiment of the present invention.

Turning to the illustrations, an embodiment of the weapon sight system, denoted by a 15, is shown in FIG. 2A, while FIG. 2B depicts a close-up view of an embodiment of the system 15.

The system 15 may include a telescopic sight 20, a computing system 30, a laser rangefinder 50 at least one device 55 for receiving an input, all in communication with each other. The invention includes a display means with the computing system 30 that provides a display within the telescopic sight 20 that depicts a computed point of aim to the shooter based upon the input received from the laser rangefinder 50, the at least one input device 55, and, if applicable, other sources of input (see FIGS. 3A, 3B).

The firearm 90, be it a rifle, handgun, or the like, may include typical elements of a firearm 90 such as a trigger area 70 (FIGS. 3A, 3B), a barrel 91 (FIG. 2A), a muzzle end 93, a stock 94, and a loading, or breech, area 92. Note too that the invention can be employed wherein the loading area 92 is at the muzzle end 93, as with typical black powder weapons, and the like. Telescopic sight 20 (FIG. 2B) has an objective lens 22 and an eye lens 21.

The system 15 (FIGS. 2A, 2B) employs various elements, that will be discussed in further detail, to ultimately improve the accuracy of the firearm 90. Specifically, by using a computing system 30 with a continually operating laser rangefinder 50 in consort with the telescopic sight 20, the predictability of the actual point of impact of the projectile (not shown) is improved, thereby giving the user a better choice as to where to aim the weapon 90 in order to hit the intended target where desired and/or whether to actually discharge the round towards the intended target based on this improved predictability. The present invention thus provides a more accurate anticipated point of impact, and a revised point of aim.

The computer system 30 in order to provide a more accurate anticipated point of impact of the projectile (see FIGS. 4A, 4B) via the display in the telescopic sight 20, must perform calculations. The calculations include the calculation of bullet drop and the calculation of lead. Bullet drop is the distance above or below the intersection of the crosshairs 5*a* where the bullet will strike at a given distance from the target. Lead is the distance to the left or right of the intersection of the crosshairs 5*a* where the bullet will strike at a given angular velocity of the target and a given crosswind. The computer system 30 may refer to various sources to perform the calculations. One source to aid in performing the computation may be ballistic tables. Another source may be ballistic information such as available via software. Infinity 5 Suite exterior ballistic program software, manufactured by Sierra of Sedalia, Mo., or similar version could be incorporated into the computer system 30, thereby providing a variety of ballistic information. This ballistic information would provide information to the computer system 30 so that the point of impact could be accurately calculated. Alternatively, ballistics information may be entered into the computer system 30 by other means. In either event, ballistic information including powder charge, bullet weight and configuration, barrel temperature, and cartridge, may be preset for specific cartridge combinations or programmed externally for particular handloads.

The laser rangefinder 50 provides distance to target. Other inputs that may be employed by the present invention may include barometric pressure. Obtaining barometric pressure may be converted by the computer system 30 to altitude, or air density, both of which effect projectile trajectory.

Another input to the computer system 30 may include angle of elevation or declination, particularly if greater than 10° of elevation or declination. Angle of elevation or declination may be obtained from a level device (e.g., bubble level, electronic level, etc.), or similar device that would compute the angle above or below horizontal of the weapon 90 and transmit this information to the computer system 30. The angle of elevation or declination, when applied by the computer system 30 will aid in the calculation of bullet drop and, in combination with computation of the angular velocity of the target, in computing lead for when the target is proceeding uphill or downhill.

Another input to the computer system 30 may include the bearing to the target. The bearing to the target can be obtained from a magnetic device (e.g., compass), or similar device that would obtain the bearing (direction) to the target and transmit this information to the computer system 30. The computer system 30 will then be able to calculate, not only the direction in which the target is headed, but will also compute the change of the bearing to the target with respect to time and hence, the angular velocity of the target.

The computer system 30 calculates lead, from input including data obtained by the laser rangefinder 50. Further, the present invention obtains the angle of elevation/declination and is able to calculate the change of the angle of elevation/declination over time. The computer system 30 is able to thereby determine whether a target is going uphill or downhill, which aids in the computation of lead.

Thus, by obtaining the change in elevation/declination over time and the change in bearing over time, the computer system 30 can calculate, at a known distance, changes in minutes-of-angle (i.e., left-right and up-down) with respect to time. Then incorporating bullet drop at a known distance to target (converted to minutes of angle), system 30 can accurately compute the point of impact, and determine a new point of aim.

Another input to the computer system 30 may include crosswind. A wind velocity sensor such as a pressure transducer within the system 15 may be employed to obtain the crosswind at the scope 20. The wind speed obtained by the pressure transducer can operate as the default wind calculation (i.e., assumed wind speed at target) for calculation purposes for the computer system 30. This wind speed computation may be overridden externally (manually) by the shooter. Using wind draft tables and distance to target system 30 would compute change in angular velocity secondary to wind velocity (left-right). This calculation would be combined with the previously computed angular velocity to yield a refinement in point of impact and correction of point of aim.

Although the aforementioned methods and devices may be employed by the present invention to calculate bullet drop and lead and therefore a new point of aim, other methods and devices may alternatively be employed.

Figure 3A:
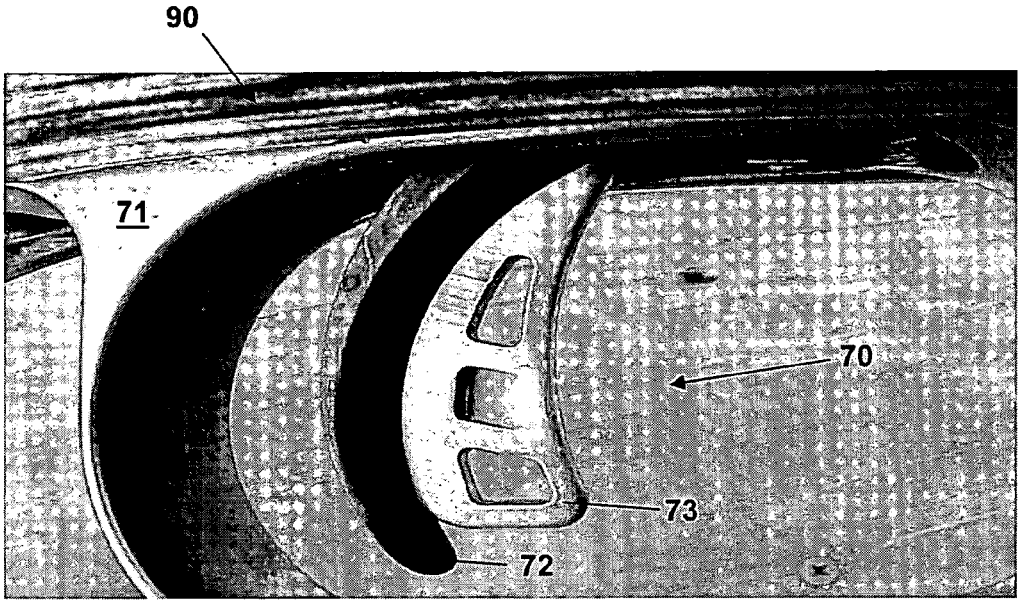
FIG. 3A shows a close-up side view of a trigger area employing the weapon sight system, according to an embodiment of the invention.
Figure 3B:
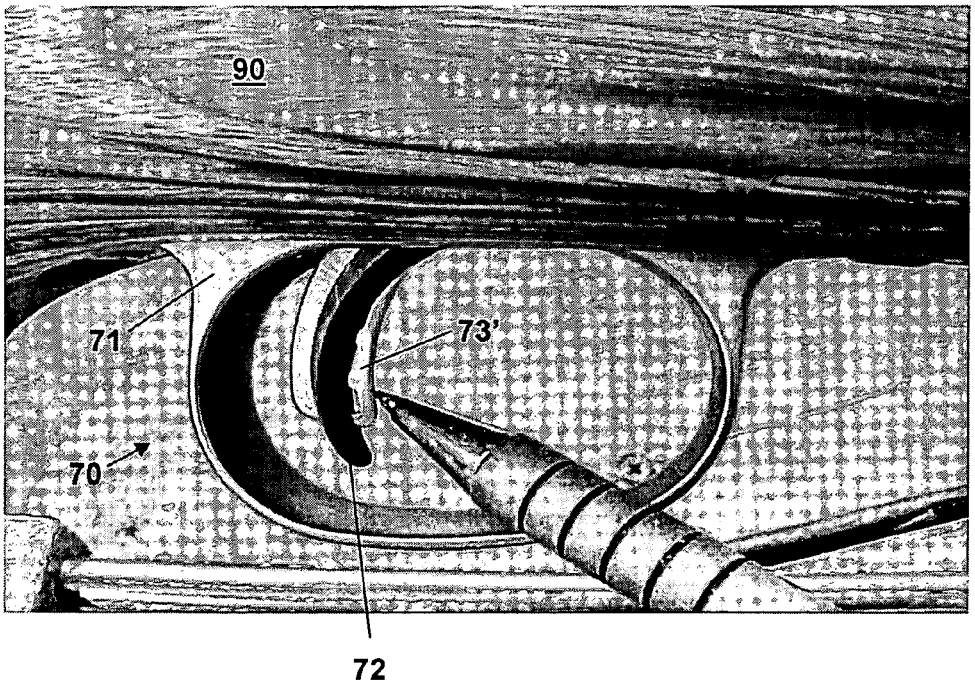
FIG. 3B shows the close-up side view of a trigger area in FIG. 3A with the auxiliary trigger activated, according to an embodiment of the invention.

FIGS. 3A and 3B depict close-up views of the trigger portion 70 of the firearm 90 in accordance with an embodiment of the present invention. The present invention may employ the trigger portion 70 of weapon 90 to activate the invention. The trigger portion 70 may include a trigger guard 71 and a primary trigger 72. The primary trigger 72 is shown in first position (i.e., 72). As is known in the art, pressing or moving the primary trigger 72 from the first position 72 to a second position (not shown) fires the projectile to the target.

Located within, anterior to, or near, the primary trigger 72 may be an auxiliary trigger 73. The auxiliary trigger 73, which is operatively attached to the system 15, is used to activate the weapon sight so as to employ the invention. An embodiment of the auxiliary trigger 73 that may be used may be similar to the trigger assemblies employed in the trigger safety features, as manufactured by Glock®, or the AccuTrigger™, as manufactured by Savage Arms.

The auxiliary trigger has a first position, denoted by 73. Similarly, the auxiliary trigger 73 has a second, or "on", position, denoted by 73' (FIG. 3B). For ease of use the second position of the auxiliary trigger 73' may be such that the anterior face of the auxiliary trigger 73' is flush with the anterior face of the primary trigger 72. In this manner, pressing or moving the auxiliary trigger to its second position 73' acts to release the trigger safety (not shown) of the weapon 90 and to activate the system 15 electronics. Specifically, pressing the auxiliary trigger 73' will cause the weapon system 15 to perform requisite measurements and calculations, which may include calculating projectile drop and lead, and position of the holographic projection 10.

If desired the shooter may release the auxiliary trigger back to its first position 73 in order to recalculate with the system 15 a second, third, or nth time. That is, each time the shooter releases the auxiliary trigger to its first position 73 and then subsequently, again, presses the auxiliary trigger to its second position 73' the system 15 will recalculate point of impact and the correct position of the holographic display 10 (FIG.4A) based on the inputted data at the time of calculation.

Typical scenarios where it may be desirable to press the auxiliary trigger 73 a second, or additional, time may be if the velocity of the target changed (e.g., elk goes from walking to running); if the elevation or declination of a moving target changed (e.g., bird flies higher and/or faster); or, if the wind velocity changed significantly.

Another example of a need to recalculate with the system 15 would be one in which the shooter realized that the probability of error from his current shooting position (e.g., standing) was too great to expect an accurate hit on the target 1. He would want to improve the likelihood of hitting the target 1 by making changes, such as a different shooting position (e.g., prone, deploying bipod, etc.), or different shooting location.

Thus, although access to implementing the system 15 of the invention near the primary trigger 72 may be desirable for ease of use, it is not a requirement. Alternatively, other parts of the firearm 90, or its attachments, may be used for auxiliary trigger 73 location(s).

Figure 4A:
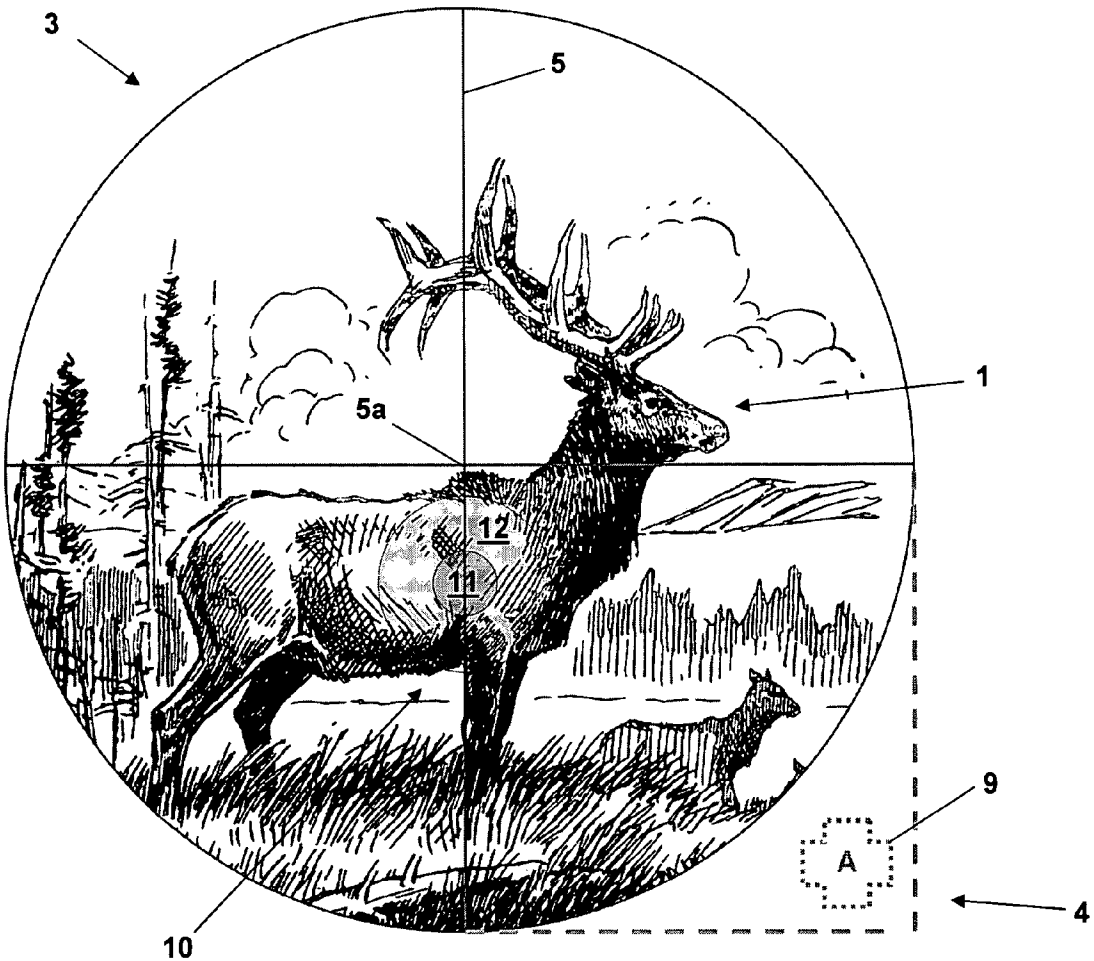
FIG. 4A shows an improved field of view of an intended target through a telescopic sight with the holographic display activated, correcting for bullet drop, according to an embodiment of the invention.
Figure 4B:
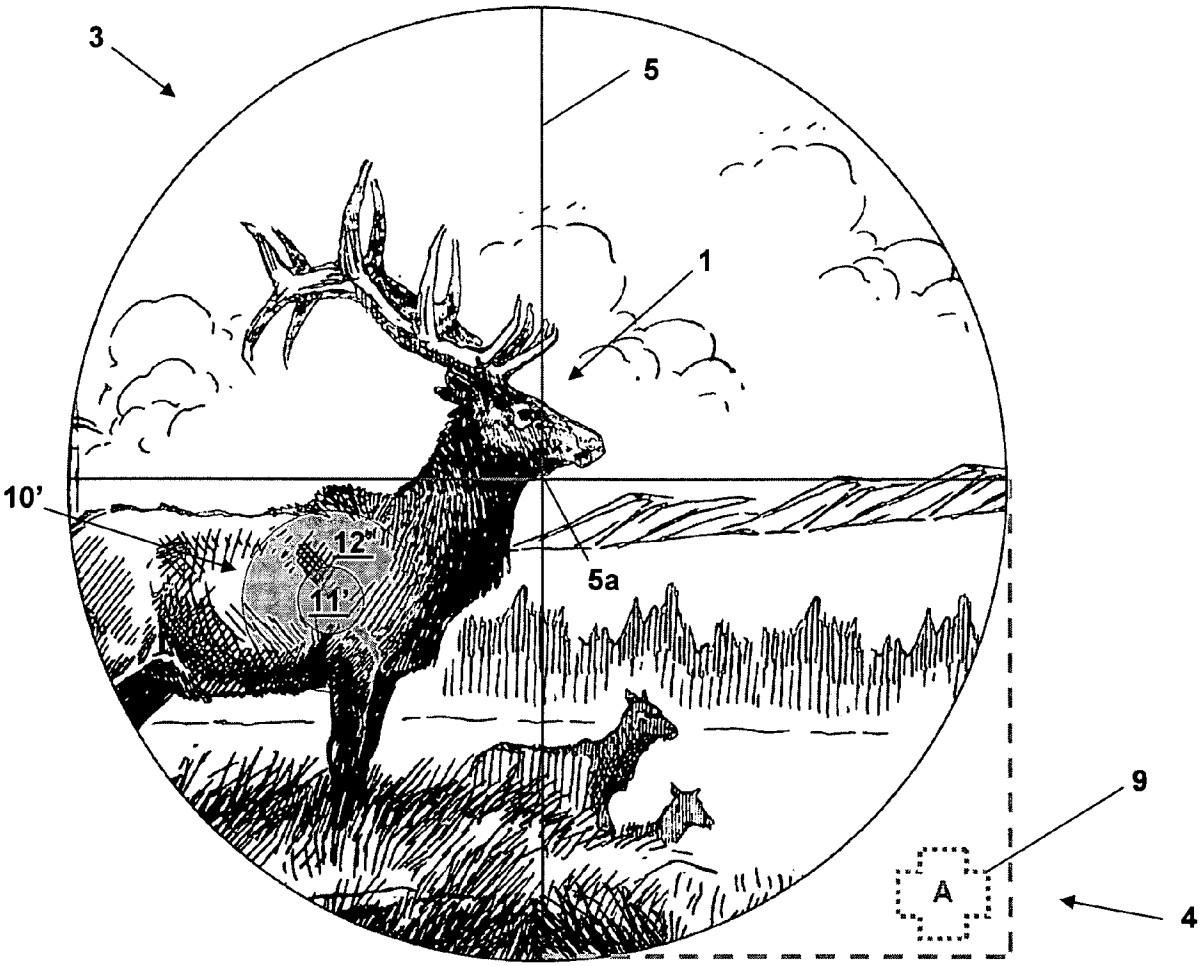
FIG. 4B shows an improved field of view of an intended target through a telescopic sight employing the weapon sight system, correcting for bullet drop and lead, according to an embodiment of the invention.

FIGS. 4A and 4B contrastingly show embodiments of the improved field of view 3 that is provided by the present invention. Similarly, there is the intended target 1 magnified and shown within the improved field of view 3. A reticle 5 may be employed. The reticle 5 may have optional illumination availability to allow dusk, dawn or nighttime use of the sight 20. While in FIGS. 4A and 4B, the crosshairs of the reticle 5 are shown centered in the improved field of view 3, it is not required that they be centered. For example, the reticle 5 crosshairs may be centered higher within the aperture to allow for holdover necessary for long-range shots (e.g., using sight 20 for targets of 800-1,000 yards).

As discussed above, in order to activate the sight 20 and system 15 of the present invention, the shooter presses the auxiliary trigger 73 to its second position 73' (See FIG. 3B). This action starts the computation process of the invention. Once the computation process is completed, a holographic visual indicator 10, 10' is projected onto the improved field of view 3 (FIGS. 4A, 4B).

Two different scenarios are depicted in FIGS. 4A and 4B. The intended target 1 (e.g., elk) in FIG. 4A is stationary, while the intended target 1 in FIG. 4B is moving (i.e., from left to right) and/or there is a measurable crosswind. Thus, the visual indicator 10, in FIG. 4A, accounts for bullet drop and/or other vertical effects, while the visual indicator 10', in FIG. 4B, accounts for bullet drop and lead, due to the movement of the intended target 1 and/or other horizontal effects.

As a result, in the scenario in FIG. 4A, the shooter aims the firearm 90 at the center of circle 11, of the visual indicator 10. For example, by positioning the crosshairs on the shoulder/near the top of the back of the elk 1, the projectile, due to bullet drop and/or other vertical effects, will more likely contact the elk 1 in the center of the visual indicator 10, in the center of the first circle 11, in the vital area of the elk 1.

Contrastingly, in the scenario in FIG. 4B (e.g., horizontal movement of elk 1 from left to right), the shooter aims the firearm 90 at the center of circle 11' of visual indicator 10'. By positioning the crosshairs 5*a* higher on the elk 1 and to the right (i.e., leading the target 1), the projectile, due to bullet drop and/or other vertical effects and the additional movement of the elk 1 and possible crosswind will contact the elk 1 in the center of the visual indicator 10', in the center of the first circle 11', in the vital area of the elk 1.

In both embodiments shown, the visual indicator 10, 10' may include two concentric circles or projections 11, 11' and 12, 12', in the field of view 3. The inner circle 11, 11' may be of a different visual presentation than the outer circle 12, 12'. For example, the inner circle 11, 11' may be of a different color, shading, density, brightness, and the like than the outer circle 12, 12', to suggest a difference in likelihood of hitting the intended target 1 in the intended location. Clearly, other visual presentations can be employed.

The visual indicator 10, 10', that is projected on the field of view 3, represents the calculated location of the point of impact of the projectile, based on various inputs 35. The first circle 11, 11' may, for example, represent the accuracy of the particular cartridge-gun-shooter combination, based upon pre-use input 36 by the shooter, shooting from a high-percentage accuracy position (e.g., prone while using a bipod). Similarly, the second circle 12, 12' then may represent the accuracy of the same pre-use input 36, but instead while shooting from a lower-percentage accuracy position (e.g., standing unsupported). The pre-use input 36, or parameters, typically are preset, and may be reset by the shooter at any time.

For example, sight 20 may have a preset, pre-use input 36 wherein the first circle 11, 11' represents 1.5 minutes of angle and the second circle 12, 12' represents 6 minutes of angle. One minute of angle corresponds to one inch at a distance of 100 yards. The first circle 11, 11' may, as a result, be approximately one-fourth the diameter of the second circle 12, 12' to represent this relationship.

Thus, in the first situation (i.e., non-moving target 1) (FIG. 4A), upon pressing the auxiliary trigger 73, the sight system 15 will make a computation based upon the data at the time of the pressing. As a result of the computation, holographic circles 11, 12 are projected onto the field of view 3 superimposed onto the target 1. Areas of the first circle 11 and the second circle 12 may be of varying shades, patterns, etc. While the holographic circle 11 depicts the point of aim of the shooter, the center of the crosshairs 5*a* depicts the point of aim of the weapon 90.

Thus, in the first situation, upon pressing the auxiliary trigger 73, the holographic image 10 (along with additional circles 11 and 12) is projected below the crosshair reticle 5. This is typically because the holographic image 10 is located based upon projectile drop based on such variables as elevation/declination, distance-to-target, cartridge, bullet and powder parameters. The shooter seeing in the field of view 3 that the holographic circle 11 is below the point of aim (i.e., crosshairs), would want to lift the weapon 90 so that the projected circle 11 is moved to the point of aim (i.e., the location on the target 1 that the shooter wants to hit). Upon then pulling the primary trigger 72 the projectile will hit the target 1 where desired.

Similarly, the second situation, as denoted by the holographic circle 11' and the additional circle 12', is typically encountered when there is significant crosswind and/or the target 1 is moving. In FIG. 4B, the elk is moving from left to right. Thus, upon the activation of the sight system 15 by auxiliary trigger 73, the computation is done, thereby projecting the holographic circle 11' upon the field of view 3. In this situation, the circle 11' is both below the point of aim (i.e., crosshairs) and to the left. As above (i.e., first situation), the circle 11' being below the point of aim, is to compensate for bullet drop from the above mentioned factors. Here though, the circle 11' is located to the side (i.e., left) of the crosshairs to account for the movement of the elk, indicating to the shooter in field of view 3 the correct "lead" for the moving target 1. Thus, the shooter is able to discern, based on the circle 11', where to move the weapon, correcting for both "holdover" and "lead" so as to hit the target 1 in the desired location.

Further, in addition to the improved field of view 3 there may be at least one border area 4 that is not overlaid onto the improved field of view 3. The at least one border area 4 may be any suitable shape and can provide a physical visual area for at least one indicator 9. The at least one indicator 9 can be alpha-numeric, textual, graphical, or a combination thereof. The at least one indicator 9 may show inputted information, ongoing conditions, stored information, or combinations thereof. By way of example only, indicator 9 is shown in phantom. Note too that the at least one indicator 9 may alternatively be overlaid over or within the actual improved field of view 3. For example, indicator 9 might represent distance to target, crosswind at the rifle, etc. The parameter(s) projected could be user selectable, with specific presets.

In order to aid the shooter, the visual indicator 10, 10' and/or the crosshairs 5 may be illuminated for dusk to dawn shots. The brightness of the illumination could be preset or programmed to vary with the ambient light. Alternatively, the amount of illumination may be overridden manually by the shooter. The illumination of the crosshairs 5 could be decreased when the shooting solution has been computed and holographic visual indicator 10 or 10' is projected, cueing the shooter to shift his point of aim from the crosshairs 5 to the holographic display.

Figure 5:
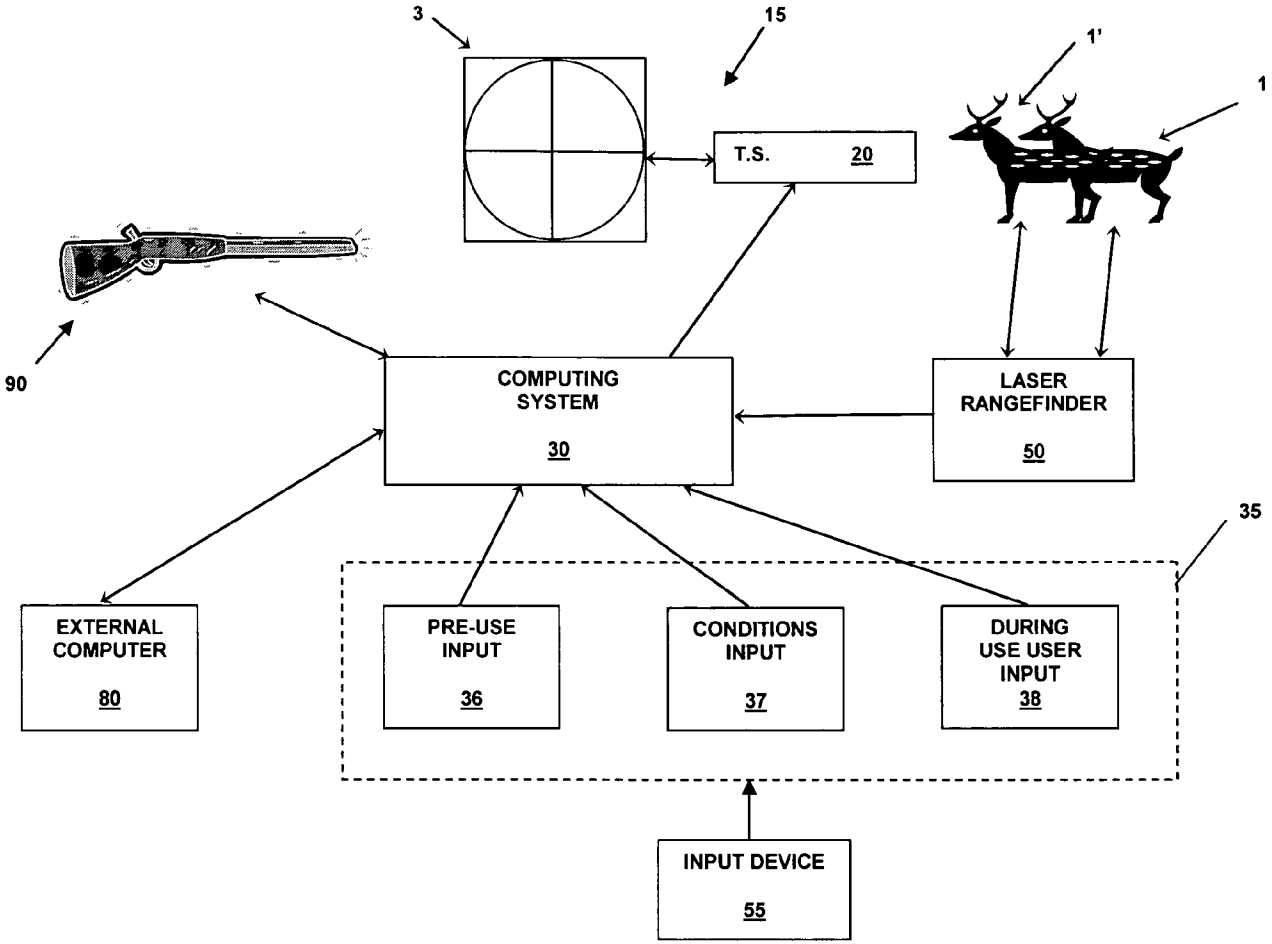
FIG. 5 shows a system diagram employing the weapon sight system, according to an embodiment of the invention.

FIG. 5 depicts a diagram of a system 15 in accordance with the present invention. The system 15 includes a computing system 30 which is attached to, or integrated with, firearm 90. When activated, computing system 30 provides additional sighting information in field of view 3 within telescopic sight 20. A laser rangefinder 50 which is attached to firearm 90 continuously tracks intended target 1. Thus, data on movement of intended target 1 from a first position 1 to a second position 1' can be obtained by the computing system 30 using information from laser rangefinder 50, as well as from other inputs.

Computing system 30 is also connected to various inputs 35 that include a pre-use input 36, conditions input 37 and a during-use input 38. Various inputs 35 may obtain data or information from at least one input device 55, or the like. Optionally an external computer 80 is may be connected to computing system 30 via communications connection 82. As a result computing system 30 may calculate, and recalculate, location of improved anticipated point of impact, circles 11 and 12. This calculation/recalculation may be done prior to firearm 90 use; prior to firearm 90 firing; during firearm 90 aiming; during firearm 90 firing; and after firearm 90 firing. Calculation stops during firearm 90 firing or after holographic projection 10 is displayed. Calculation resumes after the inner trigger has been released and allowed to return to its rest position as shown in FIG. 3A, and then recompressed as shown in FIG. 3B. The holographic display 10 remains visible until the trigger is released. Further, the calculation/recalculation may be done continually, intermittently, or singularly.

A particular advantage of the present invention is the arrangement of laser rangefinder 50 with firearm 90 and computing system 30. By continually operating laser rangefinder 50, computing system 30 is able to continuously calculate distance to intended target 1.

Pre-use input 36 includes inter alia ballistic information such as ballistic coefficient, firearm 90 information including velocity at muzzle; shooter information including vision parameters; setting of the telescopic sight 20 such as distance to point of impact that the sight 20 has been "zeroed", and other parameters. While the example above is illustrative it is not intended to be limiting, in that any pre-use input 36 would be information and data that may affect the trajectory and concomitant point of impact that may be considered fixed, or known, prior to the actual firing or firing session.

Conditions input 37 includes inter alia weather information including wind velocity and direction, barometric pressure, etc.; angle of inclination or declination of the sighting plane; barrel temperature, and the like. While the above example is illustrative it is not intended to be limiting in that conditions input 37 would be any information and data that may affect on the trajectory and concomitant point of impact that may be considered varying, and obtainable, during the actual firing or firing session.

During-use user input 38 includes inter alia information or data that the shooter can enter or adjust during the shooting session, such as overriding the actual windage obtained from conditions-input 37 so that improved anticipated point of impact is further adjusted beyond calculation conducted by computing means 20; or, adjusting the desired circle size (diameter) of an expected error; or, adjusting desired percentage change of hitting intended target; and the like. While above is illustrative it is not intended to be limiting in that during use user input 38 would be any information and data that may affect on the trajectory and concomitant point of impact that would be entered by the shooter during the actual firing or firing session.

Optionally, an external computer 80 may be attachable to computing system 30 via numerous communication means known in the art including wired, cabled, Wi-Fi, satellite, and the like. For example, external computer 80 may be attachable to computing system via USB port 31 (not shown). External computer 80 allows for data and information to be sent either from external computer 80 to computing system 30 and/or from computing system 30 to external computer 80. Such information might include GPS position of the shooter and/or computed GPS position of the target. Further, data and information from sources other than computing system 30 can be stored on external computer 80. External computer 80 can store data and information including but not limited to firearm information, ballistics information, shooter information, shooting session information, and the like.

The foregoing description of various aspects of the invention has been presented for purposes of illustration and description. It is not intended to be exhaustive or to limit the invention to the precise form disclosed, and obviously, many modifications and variations are possible. Such modifications and variations that may be apparent to a person skilled in the art are intended to be included within the scope of the invention as defined by the accompanying claims.

What is claimed is:

1. A sighting system for use with a hand-held firearm and capable of being mounted to the hand-held firearm comprising:

a telescopic sight, that provides a field of view of a desired target, wherein the field of view includes a cross-hair type reticle and a holographic visual indicator to display a computed point of aim;

a laser rangefinder, adapted to obtain a distance to the desired target;

a device for receiving an input;

an integrated global positioning system (GPS) to obtain a geographical position of at least one of the desired target or the firearm;

a computing system, for calculating the computed point of aim of a projectile based upon the input and the distance to the desired target, wherein the calculating further comprises calculating bullet drop and lead, wherein the lead includes calculating a velocity of the desired target, wherein the computed point of aim is a predicted future position of a moving target that intersects with a predicted future position of a fired bullet; and a display means configured to provide an image of the computed point of aim within the field of view.

2. The system of claim 1, wherein the firearm is a rifle.

3. The system of claim 1, wherein the device comprises a sensor.

4. The system of claim 3, wherein the sensor comprises one selected from the group consisting of: level, barometer, compass, wind velocity meter, and combinations thereof.

5. The system of claim 1, wherein said laser rangefinder obtains said distance on a continuous basis.

6. The system of claim 1, wherein the input comprises one selected from the group consisting of: ballistics information, wind velocity, angle of elevation/declination, barometric pressure, magnetic heading, and combinations thereof.

7. The system of claim 1, wherein the calculating further comprises calculating change in elevation/declination over time and change in angular velocity over time.

8. The system of claim 1, wherein the velocity of the desired target is computed from the angular velocity and the distance to the desired target.

9. A method for sighting a hand-held firearm comprising:

providing a telescopic sight, that provides a field of view of a desired target, wherein the field of view includes a cross-hair type reticle and a holographic visual indicator to display a computed point of aim;

providing a laser rangefinder, adapted to obtain a distance to the desired target;

providing a device for receiving an input;

providing an integrated global positioning system (GPS) to obtain a geographical position of at least one of the desired target or the firearm;

providing a computing system, for calculating lead and the computed point of aim of a projectile based upon the input and the distance to the desired target, wherein the lead includes calculating a velocity of the desired target, wherein the computed point of aim is a predicted future position of a moving target that intersects with a predicted future position of a fired bullet; and displaying an image of the computed point of aim within the field of view.

10. The method of claim 9 wherein the device comprises one selected from the group consisting of: level, barometer, compass, wind velocity meter, and combinations thereof.

11. The method of claim 9, wherein the laser rangefinder obtains the distance on a continuous basis.

12. The method of claim 9, wherein the input comprises one selected from the group consisting of: ballistics information, wind velocity, angle of elevation/declination, barometric pressure, magnetic heading, and combinations thereof.

13. The method of claim 9, wherein the calculating further comprises calculating bullet drop.

14. The method of claim 9, wherein the calculating further comprises calculating change in elevation/declination over time and change in angular velocity over time.

15. The method of claim 9, wherein the velocity of the desired target is computed from the angular velocity and the distance to the desired target.

16. A hand-held firearm including a telescopic sight capable of being mounted to the hand-held firearm comprising:

a sighting system, that provides a field of view of a desired target, wherein the field of view includes a cross-hair type reticle and a holographic visual indicator to display a computed point of aim;

a laser rangefinder, adapted to obtain a distance to the desired target;

a device for receiving an input;

an integrated global positioning system (GPS) to obtain a geographical position of at least one of the desired target or the firearm;

a computing system, for calculating the computed point of aim of a projectile based upon the input and the distance to the desired target, wherein the calculating further comprises calculating bullet drop and lead, wherein the lead includes calculating a velocity of the target, wherein the computed point of aim is a predicted future position of a moving target that intersects with a predicted future position of a fired bullet; and a display means configured to provide an image of the computed point of aim within the field of view;

a trigger;

a stock a barrel; and a projectile loading area.

17. The firearm of claim 16, wherein the velocity of the desired target is computed from the angular velocity and the distance to the desired target.

* * * * *